US009815111B2

(12) United States Patent
Gnali

(10) Patent No.: US 9,815,111 B2
(45) Date of Patent: Nov. 14, 2017

(54) DIE-CASTING MACHINE WITH INJECTION ASSEMBLY WITH A SHUT-OFF VALVE

(71) Applicant: ITALPRESSE INDUSTRIE S.P.A., Brescia (IT)

(72) Inventor: Alessandro Gnali, Brescia (IT)

(73) Assignee: ITALPRESSE INDUSTRIE S.P.A., Brescia (IT)

( * ) Notice: Subject to any disclaimer, the term of this patent is extended or adjusted under 35 U.S.C. 154(b) by 216 days.

(21) Appl. No.: 14/661,090

(22) Filed: Mar. 18, 2015

(65) Prior Publication Data

US 2015/0266087 A1 Sep. 24, 2015

(30) Foreign Application Priority Data

Mar. 21, 2014 (IT) ..... BS2014A0069

(51) Int. Cl.
*B22D 17/20* (2006.01)
*B22D 17/32* (2006.01)

(52) U.S. Cl.
CPC ..... *B22D 17/203* (2013.01); *B22D 17/2015* (2013.01); *B22D 17/32* (2013.01)

(58) Field of Classification Search
CPC ... B22D 17/2015; B22D 17/203; B22D 17/32
USPC ..... 266/236; 222/596; 164/153, 303, 316, 164/317, 318, 312, 314
See application file for complete search history.

(56) References Cited

U.S. PATENT DOCUMENTS 4,096,585 A * 6/1978 Fiorentini ..... B29B 7/7615 366/134
7,150,445 B2 * 12/2006 Faye ..... F16K 5/0235 251/129.11
7,810,549 B2 * 10/2010 Li ..... B22D 17/04 164/113
7,828,042 B2 * 11/2010 Li ..... B22D 17/2272 164/113

* cited by examiner

*Primary Examiner* — Scott Kastler
*Assistant Examiner* — Michael Aboagye
(74) *Attorney, Agent, or Firm* — Thomas Horstemeyer, LLP

(57) ABSTRACT

An injection assembly (2) of a hydraulic machine for diecasting is provided with a main shut-off valve (50) suitable to prevent the return of fluid from the main pressure chamber (30). The main valve (50) comprise a containment case (541), in which a return spring (540) is housed, suitable to retain any rupture fragments thereof.

13 Claims, 4 Drawing Sheets

DIE-CASTING MACHINE WITH INJECTION ASSEMBLY WITH A SHUT-OFF VALVE

CROSS-REFERENCE TO RELATED APPLICATION

This application claims priority to Italian Patent Application No. BS2014A000069, filed Mar. 21, 2014, which is herein incorporated by reference in its entirety.

The present invention relates to a hydraulically operated die-casting machine, in particular for the die-casting of light alloys. In particular, the present invention relates to an injection assembly of a die-casting machine provided with a shut-off valve.

As is known, such machines operate on a mould, consisting of two half-moulds coupling to form the cavity corresponding to the piece to be made, and consist of a closing assembly of the mould and an injection assembly, provided with an injection piston to pressurise the molten metal.

For the actuation of the injection piston, a hydraulic circuit is provided comprising a plurality of valves for controlling the actuation, subject to continuous cycles at high pressures.

The performance of such valves is of crucial importance for the proper operation of the injection piston and a rupture thereof causes the machine to stop and sometimes the pollution of the hydraulic circuit with fragments resulting from the breakage of components. The operating recovery time is often long, with imaginable consequences on plant productivity.

The object of the present invention is to provide a hydraulically operated die-casting machine provided with a valve of the actuation circuit of the injection piston which meets the aforementioned requirements and overcomes the drawbacks mentioned above with reference to the prior art.

Such purpose is achieved by a die-casting machine.

The characteristics and advantages of the die-casting machine according to the present invention will be clear from the description given below, by way of a non-limiting example, according to the appended drawings, wherein FIG. 1 shows a functional diagram of an injection assembly of a die-casting machine according to an embodiment of the present invention;

Figure 1:
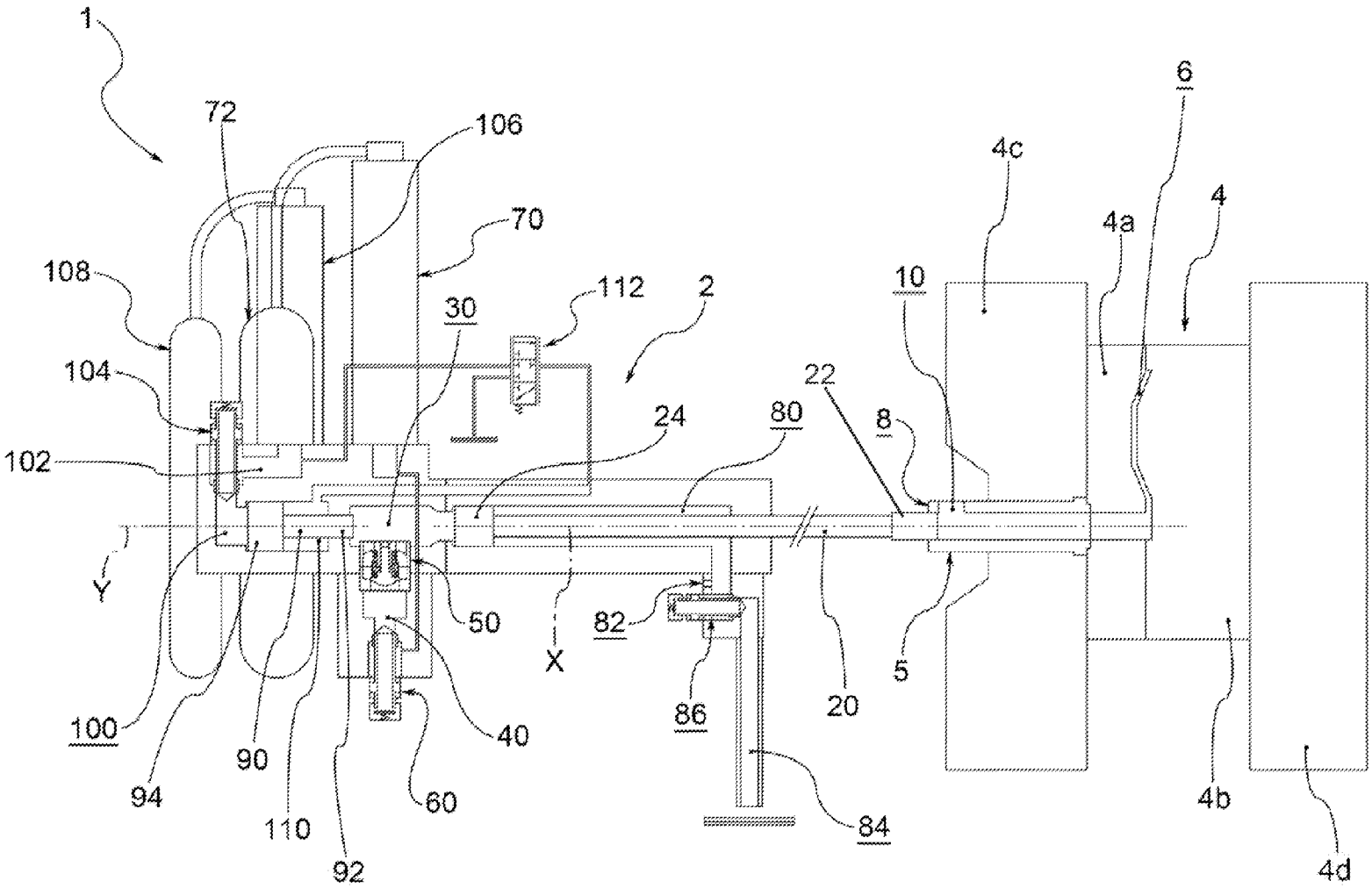
Figure 2:
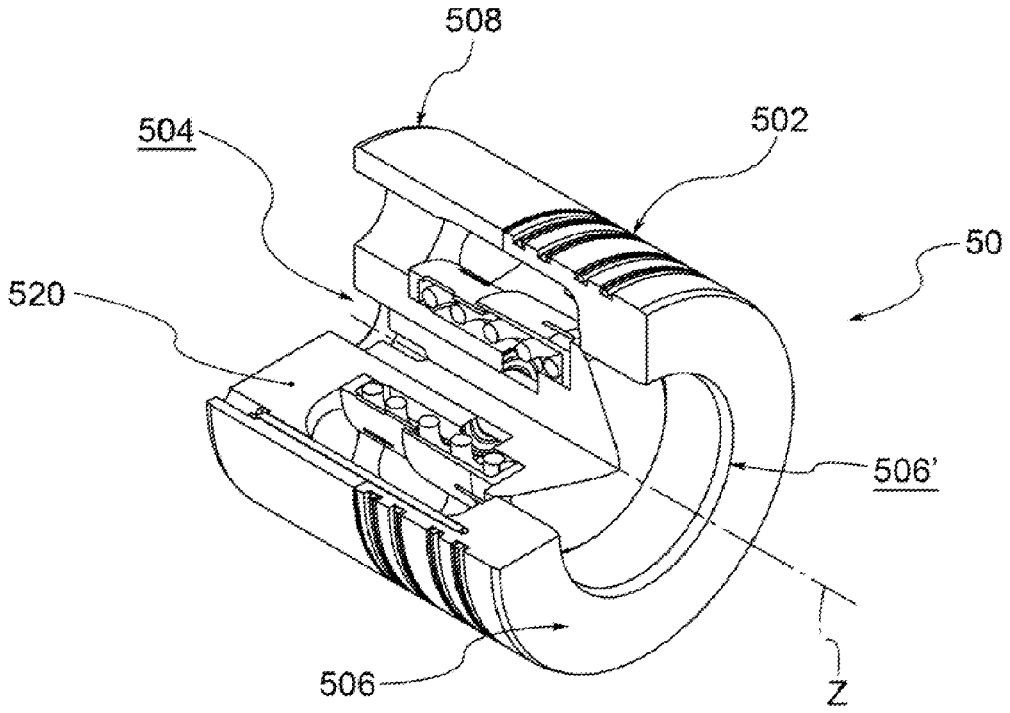
FIG. 2 shows a main shut-off valve of the injection assembly in FIG. 1, on the input side, in a closed configuration.
Figure 3:
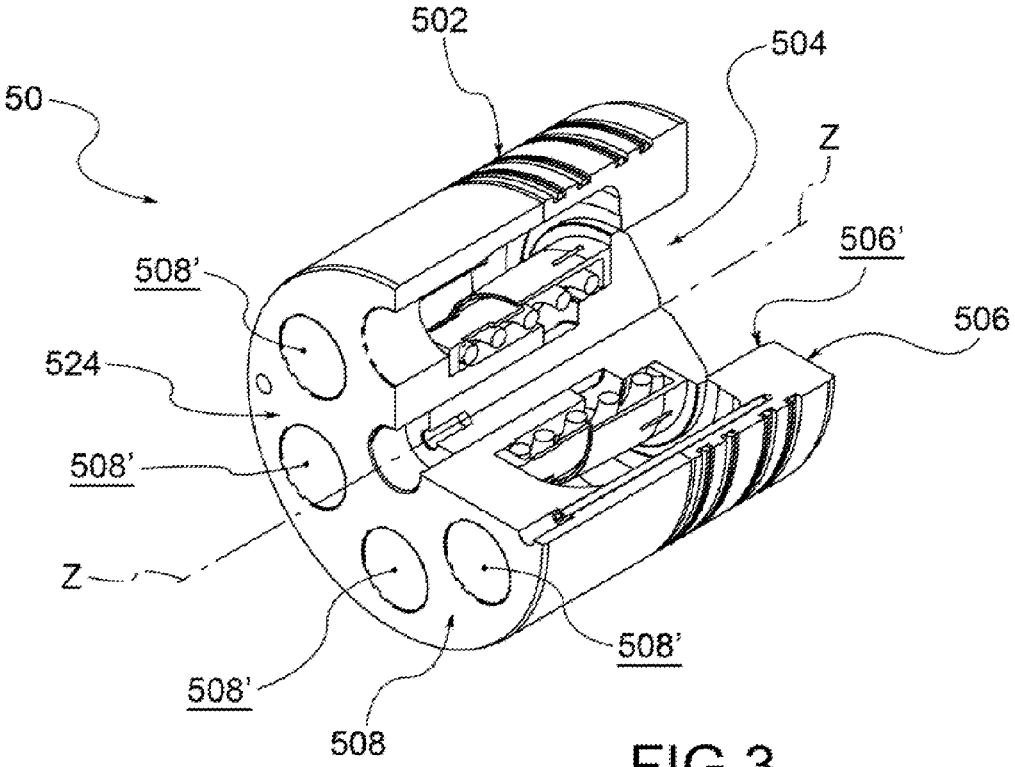
FIG. 3 shows the valve in FIG. 2, on the output side.

With reference to the appended drawings, reference numeral 1 globally denotes an assembly comprising an injection assembly 2 of a hydraulically operated die-casting machine and a mould 4, comprising two half-moulds 4*a*, 4*b*, coupling to form and delimit an internal cavity 6 corresponding to the piece to be obtained.

The machine further comprises a closing assembly which supports the mould 4 and controls its opening and closing via a fixed plate 4*c*, integral with the first half-mould 4*a*, and a movable plate 4*d*, integral with the second half-mould 4*b*.

According to the embodiments of the invention, the machine is of the "toggle-free" type or "with toggle".

The injection assembly 2 comprises a container 5, usually engaged with the fixed plate 4*c* of the closing assembly and, through this, with the mould 4; said container 5 has an insertion opening 8 and a casting channel 10 for the casting flow of the molten metal, in communication with the cavity 6 of the mould 4.

The injection assembly 2 further comprises an injection piston 20 which extends along a translation axis X between a head end 22, suitable to penetrate into the container 5 through the insertion opening 8, and an opposite tail end 24. The injection piston 20 is hydraulically operated to move on command along said translation axis X.

The machine 2 also has a main pressure chamber 30, upstream of the injection piston 20, i.e. upstream of the tail end 24 thereof, for pressurising the fluid destined for the outward translation of the injection piston 20.

In addition, the injection assembly 2 comprises a main fluid inlet 40 and a main shut-off valve 50 (described below), placed between the main inlet 40 and the main chamber 30, suitable to prevent the return of fluid from the main chamber 30 to the main inlet 40.

Additionally, the injection assembly 2 comprises a first control valve 60, located upstream of the main inlet 40, suitable to regulate the flow of fluid towards the main inlet 40, for example controlled electronically.

In addition, the injection assembly 2 comprises pressurised fluid accumulation means suitable to constitute a reserve of pressurised fluid for the machine.

Said accumulation means are operatively connected with the main inlet 40.

For example, the accumulation means comprise a first accumulator 70 and a first cylinder 72. The first cylinder 72 is connected to the accumulator 70 for loading the pressurised gas (e.g. nitrogen), while the accumulator 70 is connected upstream of the main inlet 40. The first control valve 60 is placed between the accumulator 70 and the main inlet 40.

The injection assembly 2 further comprises a main back-pressure chamber 80, downstream of the tail end 24 of the injection piston 20, connected with a return inlet 82 for supplying pressurised fluid for the return movement, i.e. in input, of the injection piston 20.

Furthermore, the main back-pressure chamber is connected with a drain 84 for discharging the fluid towards a tank; between the main back-pressure chamber 80 and the drain 84, for example upstream of said drain 84, a second control valve 86, is preferably placed, for example controlled electronically.

Furthermore, the injection assembly 2 comprises pressure multiplier means suitable to increase the pressure of the fluid contained in the main chamber 30 above the pressure supplied from the accumulator 70.

Said multiplier means comprise a multiplier piston 90 which extends along a multiplication axis Y, coinciding for example with the translation axis X of the injection piston 20, between a head end 92, suitable to operate in compression in the main chamber 30, and an opposite tail end 94.

The multiplier piston 90 is movable on command along the multiplication axis Y.

The pressure multiplier means further comprise a secondary pressure chamber 100, upstream of the multiplier piston 90, i.e. upstream of the tail end 94 thereof, and a secondary fluid inlet 102, upstream of the secondary chamber 100, for the input of pressurised fluid.

The multiplier means further comprise a third control valve 104, operable on command, for example electronically, placed between the secondary chamber 100 and the secondary inlet 102.

Moreover, said accumulation means are operatively connected with the secondary inlet 102.

For example, the accumulation means comprise a second accumulator 106, in communication with the secondary inlet 102, and a second cylinder 108, for filling the second accumulator 106 with pressurised gas (usually nitrogen).

Furthermore, the multiplier means comprise a secondary back-pressure chamber 110 downstream of the tail end 94 of the multiplier piston 90, which is connectable to the secondary inlet 102, and preferably a fourth control valve 112, controlled electronically, placed between the secondary inlet 102 and the secondary back-pressure chamber 110.

Additionally, the injection assembly 2 comprises pressure means suitable to pressurise the fluid used for moving the injection piston and/or the multiplier piston. Said pressure means are operatively connected to the accumulation means.

For example, said pressure means comprise at least one hydraulic compressor, operating at pressures between 120 bar and 220 bar.

For example, said compressors are operatively connected with the accumulators of the accumulation means.

During normal operation of the machine, the two half-moulds 4*a*, 4*b* are coupled and the liquid metal is poured into the cavity 6 through the casting channel 10 of the container 5.

The die-casting method comprises a first injection step, in which the injection piston penetrates into the container 5 at a reduced speed, to allow the molten metal to fill the accessory channels provided in the mould.

For the first injection step, for a controlled partial opening of the first control valve 60, the pressurised fluid is fed to the main inlet 40, for example at a nominal pressure of 150 bar, and from this to the main chamber 30 as a result of opening the main shut-off valve 50.

By means of the controlled opening of the second control valve 86, the main back-pressure chamber 80 releases the pressure so that the action of the fluid in the main chamber 30 and the opposite action of the fluid in the main back-pressure chamber 80 generate an outward thrust on the injection piston 20, at the reduced speed desired.

Subsequently, preferably without interruption from the previous step, the method provides for a second injection step, in which the injection piston 20 penetrates into the container 5 at a higher speed than the forward speed of the first step.

For the second injection step, for further controlled opening of the first control valve 60, for example total, the pressurised fluid is fed to the main inlet 40 at a greater flow rate and from this to the main chamber 30 as a result of opening the main shut-off valve 50.

Moreover, preferably, for the further controlled opening of the second control valve 86, the main back-pressure chamber 80 releases the pressure so that the action of the fluid in the main chamber 30 and the opposite action of the fluid in the main back-pressure chamber 80 generate an outward thrust on the injection piston 20, at the high speed desired.

Later still, preferably without interruption from the previous step, the method provides for a third injection step, in which the injection piston 20 acts in the container 5 at almost zero speed, but with high pressure, to force the molten metal, now in solidification, to offset the shrinkage suffered by cooling.

For the third injection step, the pressure multiplier means are activated.

In particular, the pressurised fluid is fed to the secondary inlet 102 and from this to the secondary pressure chamber 100 following the opening of the third control valve 104. The secondary back-pressure chamber 110 is fed with pressurised fluid in a controlled manner through the fourth control valve 112, so that the multiplier piston 90 exerts a thrust action on the fluid present in the main chamber 30, increasing the pressure thereof, for example up to 500 bar.

As a result, the main valve 50, sensitive to the pressure difference between the main inlet 40 and the main chamber 30, passes into the closed configuration, fluidically separating the main inlet 40 and the main chamber 30.

The fluid in the main chamber 30, brought to a higher pressure, thus operates on the injection piston 20, so that said piston exerts on the metal in the mould the desired action to offset the shrinkage.

After completing the third injection step, the multiplier means are deactivated; in particular, the multiplier piston 90 performs a return stroke by virtue of the pressurised fluid fed to the secondary back-pressure chamber 110 and the connection to the drain of the secondary chamber 100.

In addition, the injection piston 20 performs a return stroke by virtue of the pressurised fluid fed to the main back-pressure chamber 80 through the return inlet 82 and by virtue of the connection to the drain of the main chamber 30.

According to a preferred embodiment of the present invention, the main shut-off valve 50 comprises an outer casing 502, provided with an inner compartment 504 which extends along an axis Z of the valve; the inner compartment 504 passes through the upstream end 506, provided with an inlet opening 506', and a downstream end 508, having at least one outlet opening 508'.

The main valve 50 is housed in the machine 2, between the main inlet 40 and the main pressure chamber 30, the inlet opening 506' faces towards the main inlet 40 and the outlet opening 508' towards the main pressure chamber 30.

Preferably, the outer casing 502 comprises an upstream body 510, provided with the inlet opening 506', and a downstream body 512, provided with the outlet opening 508', coupled so as to form the inner compartment 504.

Preferably, the main valve 50 comprises a plurality of sealing rings 514, housed in respective sealing seats made on the outer lateral surface of the upstream body 510.

From the upstream end 506 towards the downstream end 508, the inner compartment 504 has a single inlet duct 516, which extends along said valve axis Z and which has said inlet opening 506', and an intermediate chamber 520.

Preferably, the inlet duct 516 is delimited peripherally by a circular cylindrical surface 517, having a predetermined axial inlet extension L1 and a predetermined inlet diameter D1.

The intermediate chamber 520 is alongside the inlet duct 516 and is peripherally delimited by a lateral surface, preferably cylindrical, having a predetermined intermediate diameter D2.

The intermediate diameter D2 is greater than the inlet diameter D1 of the inlet duct 516.

Moreover, according to a preferred embodiment, the inner compartment 504 comprises a plurality of outlet ducts 518, each ending with a respective outlet opening 508'.

For example, there are six outlet ducts 518, angularly equidistantly spaced, for example of a circular cylindrical shape.

Preferably, the downstream body 508 comprises a bottom base 524, through which said outlet ducts 518 are made.

Preferably, the bottom base 524 comprises a guide 525, for example consisting of a tubular projection extending along the valve axis Z.

Additionally, the main valve 50 comprises an obturator 530, housed in a translatable manner in the inner compartment 504 of the valve 50.

The obturator 530 comprises a head 532 suitable to close the access to the inner compartment 504 through the inlet opening 506'.

The head 532 has a main surface 534, facing the inlet opening 506', consisting of a truncated-cone surface with a rounded vertex.

Additionally, the head 532 comprises a collar 536, downstream of the main surface 534, suitable to form an axial abutment against the mouth of the inlet duct 516.

Furthermore, the obturator 530 comprises a shank 538 which extends from the head 532 along the valve axis Z, engaged in translation with the guide 525, i.e. translatable inside said tubular projection.

The main valve 50 further comprises a spring 540, housed in the inner compartment 504, in particular in the intermediate chamber 520 thereof. The spring 540 is suitable to operate permanently on the obturator 530 to keep it in a closed position of access to the inner compartment 504 through the inlet opening 506'.

Preferably, the spring 540 is arranged coaxially to the valve axis Z, and in particular is fitted onto the tubular projection 525 which forms the guide.

The main shut-off valve 50 is thus normally closed, since in the absence of adequate external actions acting on the obturator, said obturator 530 closes the access to the inner compartment 504 through the inlet opening 506'.

Moreover, preferably, the main valve 50 comprises containment means suitable to create a barrier to prevent the passage of broken fragments of the spring towards the main pressure chamber 30.

For example, said retention means comprise a containment case 541, housed in the inner compartment 504 and suitable to contain inside it the spring 540.

According to a preferred embodiment, the case 541 comprises a movable shell 542 integral with the obturator 530, for example mounted coaxially to the shank 538 on the side of the head 532.

For example, the movable shell 542 comprises a movable base 544, placed in axial abutment with an abutment wall of the obturator 530, for example in abutment with the collar 536 of the head 532. Preferably the movable base 544 presses on one end of the spring 540.

Moreover, the movable shell 542 comprises an annular movable containment wall 546, axially projecting from the movable base 544, which surrounds part of the spring 540.

Moreover, according to said embodiment, the case 541 comprises a fixed shell 552, fixed in relation to the obturator 530, for example fitted coaxially to the tubular projection 525 which forms the guide.

For example, the fixed shell 552 comprises a fixed base 554, placed in axial abutment with an abutment wall of the casing 502, for example in abutment with the bottom base 524 of the downstream body 508. Preferably, the other end of the spring 540 presses on the fixed base 554.

Furthermore, the fixed shell 552 comprises an annular fixed containment wall 556, axially projecting from the fixed base 554, which surrounds part of the spring 540.

Preferably, the fixed containment wall 556 and the movable containment wall 546 overlap axially for a portion, but still leaving a gap for the passage of the fluid.

For example, preferably, the movable containment wall 546 radially surrounds externally an end portion of the fixed containment wall 556.

According to a further embodiment, the case 541 comprises slots 560 suitable for the passage of fluid from the inside to the outside of said case.

For example, the movable shell 542 comprises a plurality of slots 560' made through the movable containment wall 546; for example, in addition, the fixed shell 552 comprises a plurality of slots 560" made through the fixed containment wall 556.

Said slots 560 preferably have an axial trend and are angularly spaced equidistantly.

Figure 5:
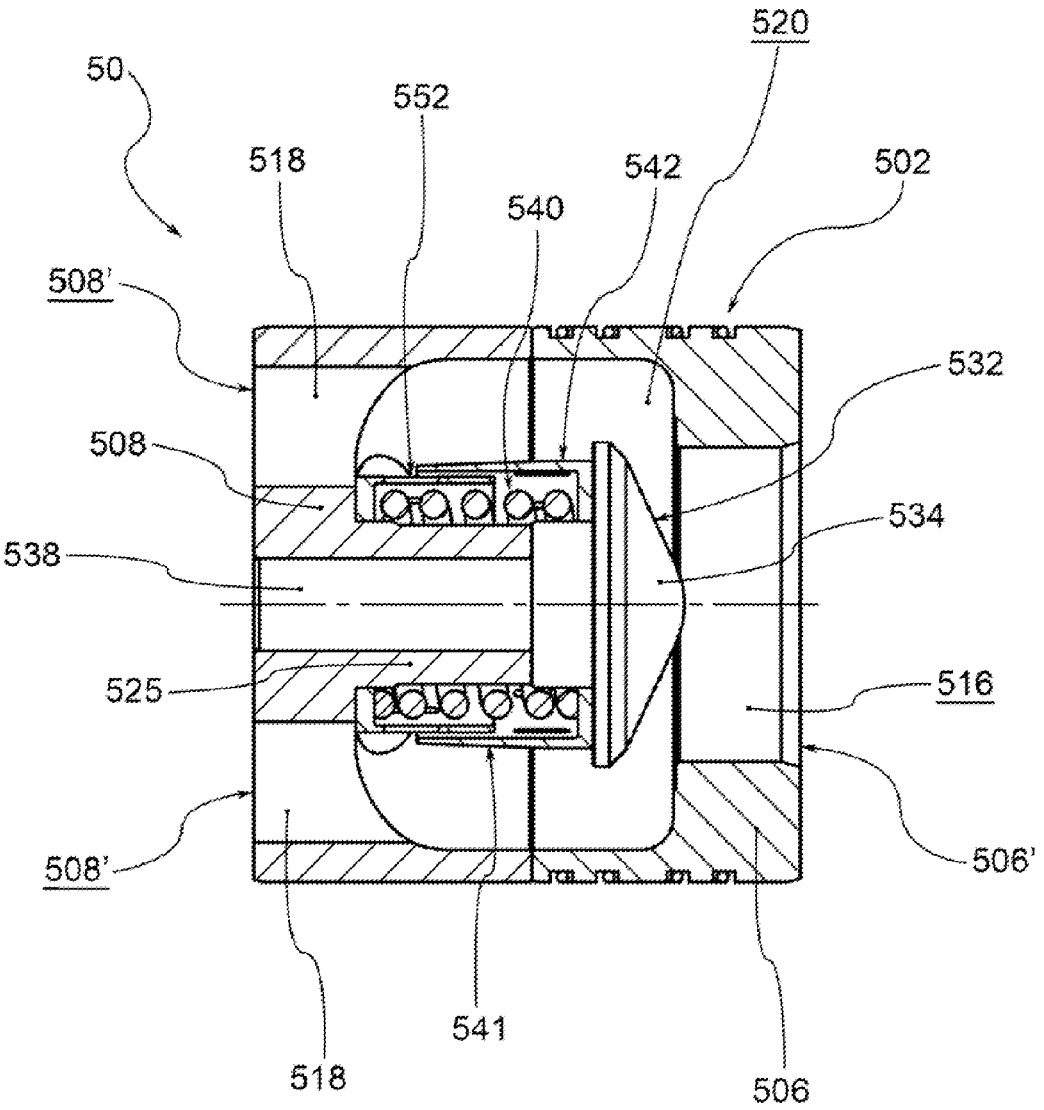
FIG. 5 shows a transversal cross-section of the main shut-off valve in FIG. 2 or 3, in an open configuration.

In a rest configuration, the main valve 50 is normally closed, i.e. assumes a closed configuration (FIG. 5).

During operation of the machine, during the first and the second injection step, the fluid fed to the main inlet 40 enters the main valve 50 through the inlet opening 506', wide enough to ensure a high flow rate of fluid.

The action of the pressurised fluid on the main surface 534 of the head 532 causes the retraction of the head 532 and the opening of access to the intermediate chamber 520. That is to say the valve brings itself into an open configuration (FIG. 5).

In said configuration, the fluid flows through the main valve 50 and in particular from the inlet duct 516 to the intermediate chamber 520 and then through the outlet ducts 518, reaching the main pressure chamber 30.

The conformation of the main surface 534 is such as to minimise the pressure drops upon the transit of the fluid between the inlet duct 516 and the intermediate chamber 520.

Figure 4:
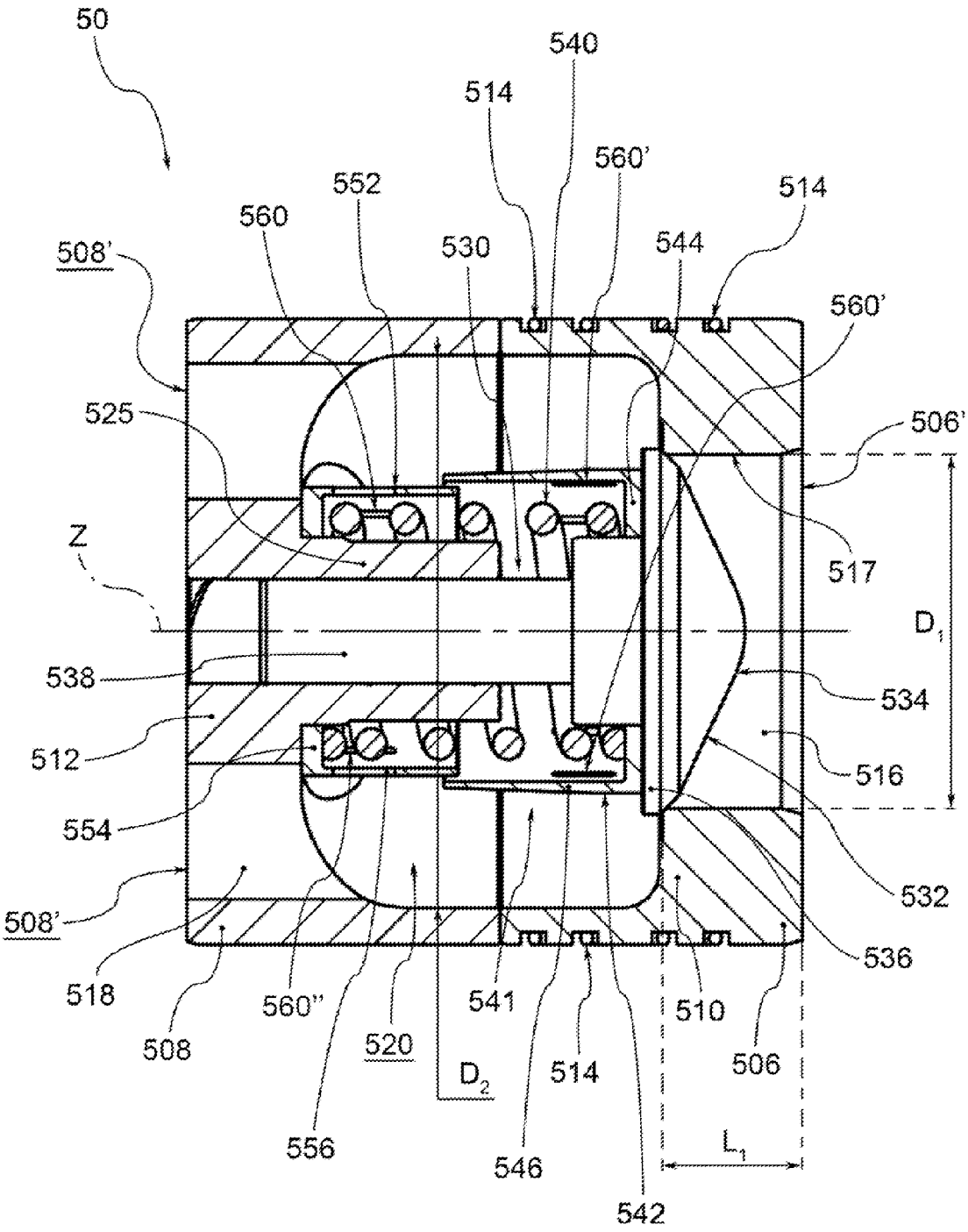
FIG. 4 is a transversal cross-section of the main shut-off valve in FIG. 2 or 3.

During the third injection step, by the action of the high pressure fluid present in the main pressure chamber 30, the main valve 50 assumes the closed configuration (FIG. 4).

During repeated cycles of opening and closing, the fluid inside the case 541 moves outside it through the gap between the movable shell 542 and the fixed shell 552 and also, advantageously, through the slots 560, which thus minimise the resistance action to opening of the fluid inside the case.

Innovatively, the machine for die casting according to the present invention and in particular the injection assembly overcome the drawbacks mentioned above with reference to the prior art.

In particular, the valve limits the intervention time in the case of breakage of the spring, as the protective case makes it possible to contain in a delimited space the fragments of spring which following a possible rupture of said spring should detach themselves from it.

According to a further advantageous aspect, the main shut-off valve is very reliable, as it allows the passage of a greater flow and lower pressure drops, thus making it possible to limit the travel of the spring for the same movement of the injection piston.

It is clear that a person skilled in the art may make modifications to the injection assembly described above so as to satisfy specific requirements, all contained within the scope of protection as defined by the following claims.

The invention claimed is:

1. An injection assembly of a hydraulic machine for die-casting, comprising an injection piston, a main inlet for inputting a fluid under pressure, a main pressure chamber upstream of the injection piston and a main shut-off valve normally in a closed configuration, operating between the main inlet and the main pressure chamber and adapted to prevent the fluid from returning from the main pressure chamber to the main inlet, wherein:

the main shut-off valve comprises a shutter and a spring adapted to operate permanently on the shutter towards the closed configuration, and containment means adapted to create a barrier to prevent spring break-up fragments from passing to the main pressure chamber;

the containment means comprise a containment case adapted to accommodate the spring and contain any spring break-up fragments thereof; and the containment case comprises a movable shell integral with the shutter and a fixed shell, fixed relative to the shutter.

2. An injection assembly according to claim 1, wherein the movable shell comprises a movable bottom, placed in axial abutment to a shutter abutment wall, and a movable annular containment wall, projecting from the movable bottom, which surrounds a part of the spring.

3. An injection assembly according to claim 2, wherein a spring end stands on the movable bottom.

4. An injection assembly according to claim 1, wherein the fixed shell comprises a fixed bottom and a fixed annular containment wall, projecting from the fixed bottom, which surrounds a part of the spring.

5. An injection assembly according to claim 4, wherein a spring end stands on the fixed bottom.

6. An injection assembly according to claim 4, wherein the fixed annular containment wall and a movable containment wall axially overlap by a length, leaving a free cavity for passage of fluid from inside of the containment case to outside of the containment case and vice versa.

7. An injection assembly according to claim 1, wherein the containment case comprises slots adapted to allow passage of fluid from inside of the containment case to the outside of the containment case.

8. An injection assembly according to claim 7, wherein a movable shell of the containment case comprises a plurality of slots made through a movable containment wall.

9. An injection assembly according to claim 7, wherein a fixed shell of the containment case comprises a plurality of slots made through a fixed containment wall.

10. An injection assembly according to claim 1, wherein the main shut-off valve is provided with an inlet opening towards a main inlet, and wherein the shutter comprises a head adapted to close the inlet opening and a shaft projecting from the head opposite to said inlet opening.

11. An injection assembly according to claim 10, wherein the head has a main surface, facing the inlet opening, consisting of a truncated-cone surface with a rounded vertex.

12. An injection assembly according to claim 10, wherein the main shut-off valve comprises an outer casing, wherein the outer casing comprises an upstream body, provided with the inlet opening, and a downstream body, provided with outlet openings, with said bodies beings coupled so as to create an inner compartment wherein the shutter is translated.

13. An injection assembly according to claim 12, wherein the outer casing comprises a bottom base having said outlet openings and comprising a guide for translatably guiding the shutter.

* * * * *